US006024251A

United States Patent [19]

Mayer et al.

[11] Patent Number: 6,024,251

[45] Date of Patent: Feb. 15, 2000

[54] DEVICE FOR DECANTING A PRESSURIZED LIQUID

[75] Inventors: Werner Mayer, Wallhausen; Helmut Ludwig, Schnelldorf, both of Germany

[73] Assignee: Robert Bosch GmbH, Stuttgart, Germany

[21] Appl. No.: 09/068,792

[22] PCT Filed: Aug. 14, 1997

[86] PCT No.: PCT/DE97/01727

§ 371 Date: May 18, 1998

§ 102(e) Date: May 18, 1998

[87] PCT Pub. No.: WO98/14372

PCT Pub. Date: Apr. 9, 1998

[30] Foreign Application Priority Data

Oct. 2, 1996 [DE] Germany ..... 196 40 664

[51] Int. Cl.[7] ..... B67D 5/08

[52] U.S. Cl. ..... 222/64; 141/83; 141/198

[58] Field of Search ..... 222/64, 189; 141/83, 141/95, 198, 192

[56] References Cited

U.S. PATENT DOCUMENTS

| | | | |
|---|---|---|---|
| 4,450,981 | 5/1984 | Haig | 222/64 |
| 5,148,945 | 9/1992 | Geatz | 222/1 |
| 5,680,960 | 10/1997 | Keyes et al. | 222/64 |
| 5,819,816 | 10/1998 | Mayer | 141/83 |

*Primary Examiner*—Steven O. Douglas
*Attorney, Agent, or Firm*—Edwin E. Greigg; Ronald E. Greigg

[57] ABSTRACT

A device for decanting a pressurized liquid into packaging containers, such as ampules, vials, or the like, having a reservoir for the liquid and a distributor that is connected to the reservoir via a supply line. A sterilizing filter is interposed in the supply line. In order to make it possible for the distributor to be completely emptied, the device embodies a separate pressure connection which applies a second pressure on the distributor so that the liquid disposed in the distributor is acted on with a second gas pressure (P2).

3 Claims, 1 Drawing Sheet

DEVICE FOR DECANTING A PRESSURIZED LIQUID

PRIOR ART

The invention relates to a device for decanting pressurized liquid into packaging containers, as has been disclosed, for example, by EP 0 430 897 B1. This device has a gas pressurized reservoir that is for a liquid and is connected via a supply line to a distributor that is in turn connected to filling valves associated with the packaging containers.

In order to prevent germs contained in the liquid from getting into the packaging containers, especially with pharmaceutical products, it is known to convey the liquid through a sterilizing filter before the decanting. So that no other germs can get into the liquid after it passes through the sterilizing filter, this filter is disposed as close as possible to the decanting mechanisms or the filling valves. For space and handling reasons, though, in most cases, it is not possible to dispose the sterilizing filter in the flow path between the distributor and the filling valves; it is more often situated directly upstream of the distributor.

The ceramic-containing sterilizing filters usually used, though, have the disadvantage that they have a shutoff action as soon as they are merely acted on with a gas pressure in the through flow direction, i.e. that there is no more liquid in the sterilizing filter. Only with a very much higher gas pressure, for which the operation of the device is not otherwise designed, is the shutoff action neutralized once more. With the above mentioned generic type of devices, which have a reservoir and a distributor and also have a sterilizing filter preceding them, this means that the reservoir can in fact be completely emptied, but that due to the above mentioned shutoff action of the sterilizing filter, however, liquid remains in the distributor, which can no longer be decanted due to the low liquid pressure still prevailing there. Particularly with expensive pharmaceutical products, this liquid remaining in the distributor represents a considerable cost factor, which encumbers the operation of the device and consequently the price of the end product.

ADVANTAGES OF THE INVENTION

The device according to the invention, for decanting a pressurized liquid, has the advantage over the prior art that even the liquid quantity remaining in the distributor when the reservoir is emptied can be used for decanting into the packaging containers. As a result, the operation of the device is less costly. This is achieved according to the invention by virtue of the fact that the distributor has a separate pressure connection so that the liquid disposed in the distributor is acted on by a second gas pressure that is independent of the pressure in the reservoir.

Other advantages and advantageous modifications of the device according to the invention that is for decanting a pressurized liquid ensue from the dependent claims and the description.

BRIEF DESCRIPTION OF THE DRAWING

Two exemplary embodiments of the invention are represented in the drawing and will be explained in more detail in the description below.

DESCRIPTION OF THE EXEMPLARY EMBODIMENTS

Figure 1:
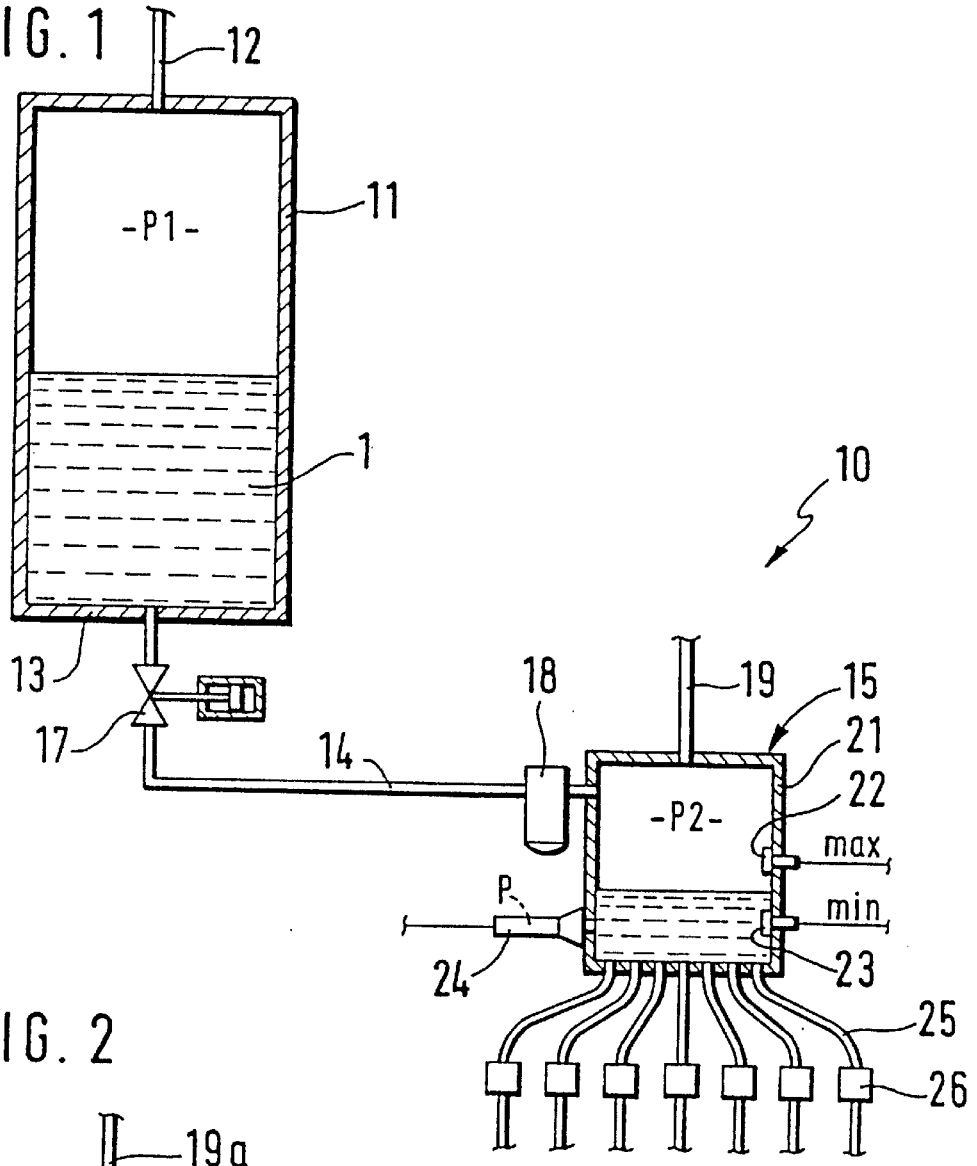
FIG. 1 shows a first device for decanting a pressurized liquid in a schematic representation.

The device 10 for decanting a liquid 1 shown in FIG. 1 has a product container 11 for the liquid 1. The product container

11 is connected to a first pressure line 12 which is connected to a pressure source, not shown, and acts on the liquid 1 disposed in the product container 11 with a first gas pressure P1. A supply line 14 leads from the bottom 13 of the product container 11 and feeds into a distributor 15. A shutoff valve 17 and a sterilizing filter 18 are interposed in the supply line 14 in terms of the flow direction of the liquid 1, wherein the sterilizing filter 18 is disposed in the immediate vicinity upstream of the distributor 15.

The top side of the cylindrically embodied distributor 15 is fed by a second pressure line 19, via which the liquid 1 disposed in the distributor 15 is acted on with a second gas pressure P2. A first fill level sensor 22 for detecting an upper fluid level and a second fill level sensor 23 for detecting a lower fluid level are disposed in a side or jacket wall 21 of the distributor 15. The two fill level sensors 22, 23 are coupled to the control unit of the device 10. The distributor 15 is also connected to a pressure sensor 24 which detects the total pressure P prevailing in the liquid 1 in the distributor 15, which total pressure is comprised of the hydrostatic partial pressure of the liquid 1 and the gas partial pressure P2. Filling hoses 25 lead from the bottom of the distributor 15 and are each connected to a filling valve 26 that can be moved up and down. Each filling valve 26 is associated with a packaging container, not shown, for example a vial, an ampule, or the like.

The packaging containers are supplied in a known, cyclical manner to the filling valves 26 to be filled with a particular quantity of liquid, and are conveyed further after being filled. The dosing of the liquid quantity is regulated by means of the control unit of the device 10, taking into account the total pressure P of the liquid 1 detected by the pressure sensor 24.

If the fluid level of the liquid 1 in the distributor 15 has exceeded the lower fill level detected by the second fill level sensor 23, the shutoff valve 17 is opened by the control unit of the device 10 so that liquid 1 can flow in from the product container 11, replenishing the distributor 15. As a result, it is required that the gas pressure P1, together with the hydrostatic liquid pressure prevailing up to the mouth on the distributor 15, is greater than the gas pressure P2 prevailing in the distributor 15. This condition must also be fulfilled for the complete emptying of the product container 11. As a rule, despite the pressure loss by means of the sterilizing filter 18, these conditions can be achieved when the gas pressure P1 is greater than the gas pressure P2.

Figure 2:
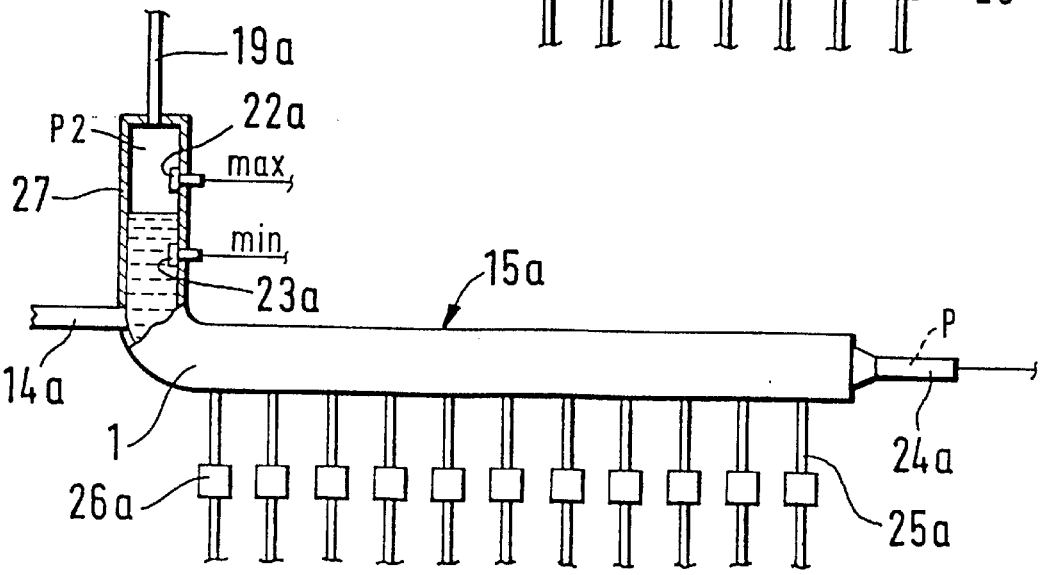
FIG. 2 shows a second exemplary embodiment, likewise in a schematic representation.

The distributor 15*a* of a second embodiment of the is invention, represented in FIG. 2, differs from the distributor 15 in FIG. 1 by virtue of the fact that the distributor 15*a* is now embodied as tubular, wherein the main extension direction of the distributor 15*a* runs horizontally. Furthermore, the distributor 15*a* has a tube section 27 that leads from one end face and protrudes vertically upward, in which the two fill level sensors 22*a*, 23*a* are disposed. The second pressure line 19*a* feeds into the top of the tube section 27, whereas the supply line 14*a* feeds into the distributor 15*a* at the level of the distributor 15*a* on the same side as the tube section 27.

Because the distributor 15*a* is now embodied as tubular, the filling hoses 25*a* can be embodied as shorter than in the distributor 15 since the filling hoses 25*a* can be disposed directly above the packaging containers. This results in the fact that the length of the distributor 15*a* is oriented toward the required space for the packaging containers that are respectively supplied in cyclical fashion. In contrast to this, in the distributor 15 in the first exemplary embodiment according to FIG. 1, due to the cylindrical distributor 15 (with vertical main extension direction), longer filling hoses 25 or ones that are disposed in a curved shape are required.

Furthermore, the distributor 15*a*, due to its shape, permits advantages with regard to a CIP (clean in place) or SIP (sterile in place) cleaning. A tubular embodiment of the distributor 15*a* is useful, particularly with small filling quantities in the packaging containers, which also only require a small total volume of the distributor 15.

The foregoing relates to preferred exemplary embodiments of the invention, it being understood that other variants and embodiments thereof are possible within the spirit and scope of the invention, the latter being defined by the appended claims.

We claim:

1. A device (10) for decanting a pressurized liquid (1) into packaging containers, such as ampules, vials, or the like, comprising a reservoir (P1) for the liquid (1), said liquid is acted on by a first gas pressure (P1), a tubular having a horizontal main extension direction distributor (15*a*) is coupled to filling valve devices (25*a*, 26*a*) and is connected to the reservoir (11) via a supply line (14*a*), the distributor (15*a*) has a region (27) that protrudes vertically upward and disposed on a side remote from the filling valve mechanisms (25*a*, 26*a*), and at least one fill level measuring device (22*a*, 23*a*) is disposed in said region (27), a filter element (18) for filtering the liquid (1) is disposed in the supply line (14*a*) between the reservoir (11) and the distributor (15*a*), and that the distributor (15*a*) has an additional pressure connection (19*a*) for acting on the liquid (1) disposed in the distributor (15*a*) with a second gas pressure (P2).

2. A device (10) for decanting a pressurized liquid (1) into packaging containers, such as ampules, or vials, comprising a reservoir (11) for the liquid (1), said liquid is acted on by a first gas pressure (P1), a tubular having a horizontal main extension direction distributor (15*a*) is coupled to filling valve devices (25*a*, 26*a*) and is connected to the reservoir (11) via a supply line (14*a*), distributor (15*a*) has a region (27) that protrudes vertically upward and is disposed on a side remote from the filling valve mechanisms (25*a*, 26*a*), and at least one fill level measuring device (22*a*, 23*a*) is disposed in said region 27, a filter element (18) for filtering the liquid (1) is disposed in the supply line (14*a*) between the reservoir (11) and the distributor (15*a*), and that the distributor (15*a*) has an additional pressure connection (19*a*) for acting on the liquid (1) disposed in the distributor (15*a*) with a second gas pressure (P2), and a pressure sensor (24*a*) is disposed in the distributor (15*a*) for detecting a total pressure of the liquid (1).

3. A device (10) for decanting a pressurized liquid (1) into packaging containers, such as ampules, or vials, comprising a reservoir (11) for the liquid (1), said liquid is acted on by a first gas pressure (P1), a tubular distributor (15*a*) having a horizontal main extension direction is coupled to filling valve devices (25*a*, 26*a*) and is connected to the reservoir (11) via a supply line (14*a*), the distributor (15*a*) has a region (27) that protrudes vertically upward and is disposed on a side remote from the filling valve mechanisms (25*a*, 26*a*), and at least one fill level measuring device (22*a*, 23*a*) is disposed in said region (27), a filter element (18) is disposed in the supply line (14*a*) in an inlet region of the distributor (15*a*) between the reservoir (11) and the distributor (15*a*), and that the distributor (15*a*) has an additional pressure connection (19*a*) for acting on the liquid (1) disposed in the distributor (15*a*) with a second gas pressure (P2).

* * * * *